US008369750B2

(12) United States Patent
Itagaki et al.

(10) Patent No.: US 8,369,750 B2
(45) Date of Patent: Feb. 5, 2013

(54) DEVELOPING DEVICE

(75) Inventors: Seiko Itagaki, Hachioji (JP); Hiroshi Akita, Musashino (JP); Natsuko Minegishi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 74 days.

(21) Appl. No.: 12/810,831

(22) PCT Filed: Jul. 17, 2009

(86) PCT No.: PCT/JP2009/062961
§ 371 (c)(1),
(2), (4) Date: Jun. 25, 2010

(87) PCT Pub. No.: WO2010/016374
PCT Pub. Date: Feb. 11, 2010

(65) Prior Publication Data

US 2011/0274468 A1 Nov. 10, 2011

(30) Foreign Application Priority Data

Aug. 8, 2008 (JP) ..... 2008-205267

(51) Int. Cl.
*G03G 15/08* (2006.01)

(52) U.S. Cl. ..... 399/252; 399/254; 399/281

(58) Field of Classification Search ..... 399/252, 399/254, 277, 281
See application file for complete search history.

(56) References Cited

FOREIGN PATENT DOCUMENTS

| | | |
|---|---|---|
| JP | 2006-243112 | 9/2006 |
| JP | 2006-317507 | 11/2006 |
| JP | 2007-065123 | 3/2007 |
| JP | 2007-65123 | 3/2007 |

OTHER PUBLICATIONS

English-language International Search Report from the Japanese Patent Office mailed Sep. 8, 2009, for International Application No. PCT/JP2009/062961.

*Primary Examiner* — David Gray
*Assistant Examiner* — Erika J Villaluna
(74) *Attorney, Agent, or Firm* — Finnegan, Henderson, Farabow, Garrett & Dunner, L.L.P.

(57) ABSTRACT

Provided is a developing device which can prevent the occurrence of a phenomenon of an excessive increase of a developer quantity in a developer standby space, thereby acquiring a stable image. The developing device comprises a developer agitation-transfer unit, a developer roller, a developer feeding roller, a developer guide member and a space forming member. The developing device is characterized in that the developer feeding roller rotates to transfer the developer transferred by the agitation-transfer means, upward from the clearance between the developer feeding roller and the developer guide member, and in that, when the developer standby space formed in the device is filled with the developer transferred by the developer feeding roller, the developer feeding roller is rotated to carry the developer, which overflows from the developer standby space, and to move the same in the direction away from the developer roller, so that the developer is once discharged from the developer standby space.

5 Claims, 5 Drawing Sheets

DEVELOPING DEVICE

CROSS REFERENCE TO RELATED APPLICATIONS

This application is a national phase application based on International Application No. PCT/JP2009/062961, filed Jul. 17, 2009, which claims the priority of Japanese Patent Application No. 2008-205267, filed Aug. 8, 2008, the content of both of which is incorporated herein by reference.

TECHNICAL FIELD

The present invention relates to a developing device, which develops an electrostatic latent image formed on an image carrier, used for copiers, printers, facsimile machines, or image forming apparatuses with multifunction employing an electrophotographic technology.

BACKGROUND

Conventionally, there has existed a developing device mainly incorporating a developing roller and a plurality of stirring and conveying screws. A developing device with this constitution produces the advantage of realization of size reduction. However, this developing device is inadequate in terms of uniform stirring of a developer, producing then such a disadvantage that it is inferior to ensure uniformity of image density in a copy page with solid black.

Namely, only when there is simply employed such a constitution in which one stirring and conveying screw feeds a developer to a developing roller and also collects the used developer and a plurality of stirring and conveying screws convey the developer in the axial direction each reversely, it is difficult to ensure density uniformity of the developer. When the mobility of the developer is degraded, the problem of occurrence of density non-uniformity corresponding to a screw pitch is produced in some cases. Especially in color equipment, copying of a high printing rate is frequently carried out. Therefore, it is critical to prevent image density non-uniformity.

To prevent such image density non-uniformity, a technology is disclosed in which a developer feed roller is provided as a transferring member of a developer from a developer stirring and conveying roller to a developer roller (for example, refer to Patent Document 1).

FIG. 6 shows a developing device 4 having the constitution disclosed in Patent Document 1. In FIG. 6, a developing roller 41, a first developer stirring and conveying roller 43, and a second developer stirring and conveying roller 44 are arranged in a lower housing 40A, and in the upper portion thereof, a developer feed roller 45 and a developer guide member 46 are arranged.

The developer feed roller 45 arranged above the first developer stirring and conveying roller 43 rotates a sleeve rotatably provided in the external circumference of a fixed magnet to feed a developer having been transferred from the first developer stirring and conveying roller 43 to the developing roller 41.

The developer conveyed from the flowing inlet 45A remains in a space 50A formed with the developing roller 41, a developer layer thickness regulating member 42, the developer feed roller 45, the developer guide member 46, and a space forming member 52, and a part thereof is fed to the developing roller 41 via the developer layer thickness regulating member 42.

The amount of the developer conveyed from the flowing inlet 45A is larger than that fed to the developing roller 41, whereby the amount of the developer remaining in the space (hereinafter also referred to as "developer standby space") 50A is increased. Then, the overflowed developer falls down from a gap between the developer fed roller 45 and the developer guide member 46.

However, the mobility of the developer in the developing device varies in some cases, depending on conditions such as variation of the bulk state of the developer, variation of the ambience state, the durability of the developer, or downtime duration.

Especially when a large number of images are formed with relatively low printing rates, the consumption of a toner is decreased, whereby the toner remaining in the developing device for a long term is increased. Thereby, produced is such a problem that some additives coated on the external side of the toner particles penetrate into the interior of the toner via friction with a carrier, resulting in a decrease in developer mobility.

In the constitution described in Patent Document 1, when the mobility of a developer is decreased, in the case of a narrow gap between the developer feed roller 45 and the developer guide member 46, the developer is difficult to fall down from the gap, resulting in the possibility of an increase in the amount of the developer remaining in the developer standby space 50A. Further, when the gap is excessively widened, the amount falling down is increased and the amount remaining in the developer standby space 50A is decreased, whereby the amount of the developer feedable to the developing roller 41 is decreased, resulting in the problem that developer feeding to the developing roller 41 becomes unstable.

When the mobility of the developer remaining in the developer standby space 50A is decreased and then the amount of the developer is increased, the friction force between the toner and the carrier is increased, whereby an excessive stress is applied to the developer. When such an excessive stress is applied to the developer, the mobility of the toner is degraded due to burying of additives, and the charging performance of the carrier is deteriorated due to abrasion of the coated layer on the surface thereof, resulting in such a problem that image density non-uniformity tends to occur and then image quality is degraded. Further, due to a decrease in resistance via layer abrasion of the carrier, a phenomenon referred to as carrier development also tends to occur in which a carrier adheres to an image formed on an output sheet.

Further, due to an increase in the friction force between the toner and the carrier in the developing device, the temperature therein is increased, resulting in such a problem that the toner is easily softened. When the toner is softened, additives coated on the toner tend to penetrate into the interior of the toner, whereby there are produced such problems that adhesion force to the carrier is further increased and the softened toner is liable to adhere to various portions of the image forming apparatus.

PRIOR ART DOCUMENTS

Patent Document

Patent Document 1: Unexamined Japanese Patent Application Publication (hereinafter referred to as JP-A) No. 2006-317507

SUMMARY OF THE INVENTION

Problems to be Solved by the Invention

An object of the present invention is to eliminate the above problems; to prevent occurrence of a phenomenon in which the amount of a developer in a developer standby space is excessively increased; and to provide a developing device realizing a stable image.

Means to Solve the Problems

The above object is achieved by the following constitution:

1. A developing device provided with a stirring and conveying member to convey a developer while stirring; a developing roller to convey a developer to a developing area by being supported; a developer feed roller, arranged above the stirring and conveying member, to receive a developer conveyed from the stirring and conveying member and to feed the developer toward the developing roller; a developer guide member, arranged between the developer feed roller and the developing roller, to guide a developer conveyed by the developer feed roller toward the developing roller while the developer is allowed to accumulate; and a space forming member, arranged above the developer feed roller and the developer guide member, to form a developer standby space, together with the developing roller, the developer feed roller, and the developer guide member, to allow a developer fed to the developing roller to temporarily stand by, wherein the developer feed roller rotates to convey the developer, conveyed by the stirring and conveying member, upward from a gap between the developer feed roller and the developer guide member.

2. The developing device, described in item 1, wherein the developer feed roller, incorporating a fixed magnetic member provided with a plurality of magnetic poles in the interior and a rotating sleeve arranged in the external circumference of the fixed magnetic member, loads a developer conveyed from the stirring and conveying member onto the sleeve to form a developer layer; the developer guide member is provided with a developer amount regulating section at a position opposite to the developer feed roller; and the minimum value of the gap between the developer amount regulating section and the developer feed roller is set to be smaller than the thickness of a developer layer formed on the sleeve.

3. The developing device, described in item 1 or 2, wherein the developer feed roller, incorporating a fixed magnetic member provided with a plurality of magnetic poles in the interior and a rotating sleeve arranged in the external circumference of the fixed magnetic member, loads a developer conveyed from the stirring and conveying member onto the sleeve to form a developer layer; the developer guide member is provided with a developer amount regulating section at a position opposite to the developer feed roller; and repulsive magnetic poles are arranged for the fixed magnetic member in the rotating direction of the sleeve from a position opposite to the developer amount regulating section.

4. The developing device, described in any of items 1-3, wherein the developer feed roller, incorporating a fixed magnetic member provided with a plurality of magnetic poles in the interior and a rotating sleeve arranged in the external circumference of the fixed magnetic member, loads a developer conveyed from the stirring and conveying member onto the sleeve to form a developer layer; the developer guide member is provided with a developer amount regulating section at a position opposite to the developer feed roller; and N poles and S poles are arranged at a position opposite to the stirring and conveying member of the fixed magnetic member.

5. The developing device, described in any of items 1-3, wherein the developer feed roller, incorporating a fixed magnetic member provided with a plurality of magnetic poles in the interior and a rotating sleeve arranged in the external circumference of the fixed magnetic member, loads a developer conveyed from the stirring and conveying member onto the sleeve to form a developer layer; the developer guide member is provided with a developer amount regulating section at a position opposite to the developer feed roller, and magnetic poles which are repulsive poles are arranged at a position opposite to the stirring and conveying member of the fixed magnetic member.

Effects of the Invention

According to the present invention, an excessive developer in a developer standby space is discharged and then the amount of the developer accommodated in the developer standby space is appropriately maintained, whereby no excessive stress is applied to the developer, resulting in the output of a stable image free from density non-uniformity.

PREFERRED EMBODIMENT OF THE INVENTION

The present invention will now be described based on an embodiment that by no means limits the scope of the present invention.

Figure 1:
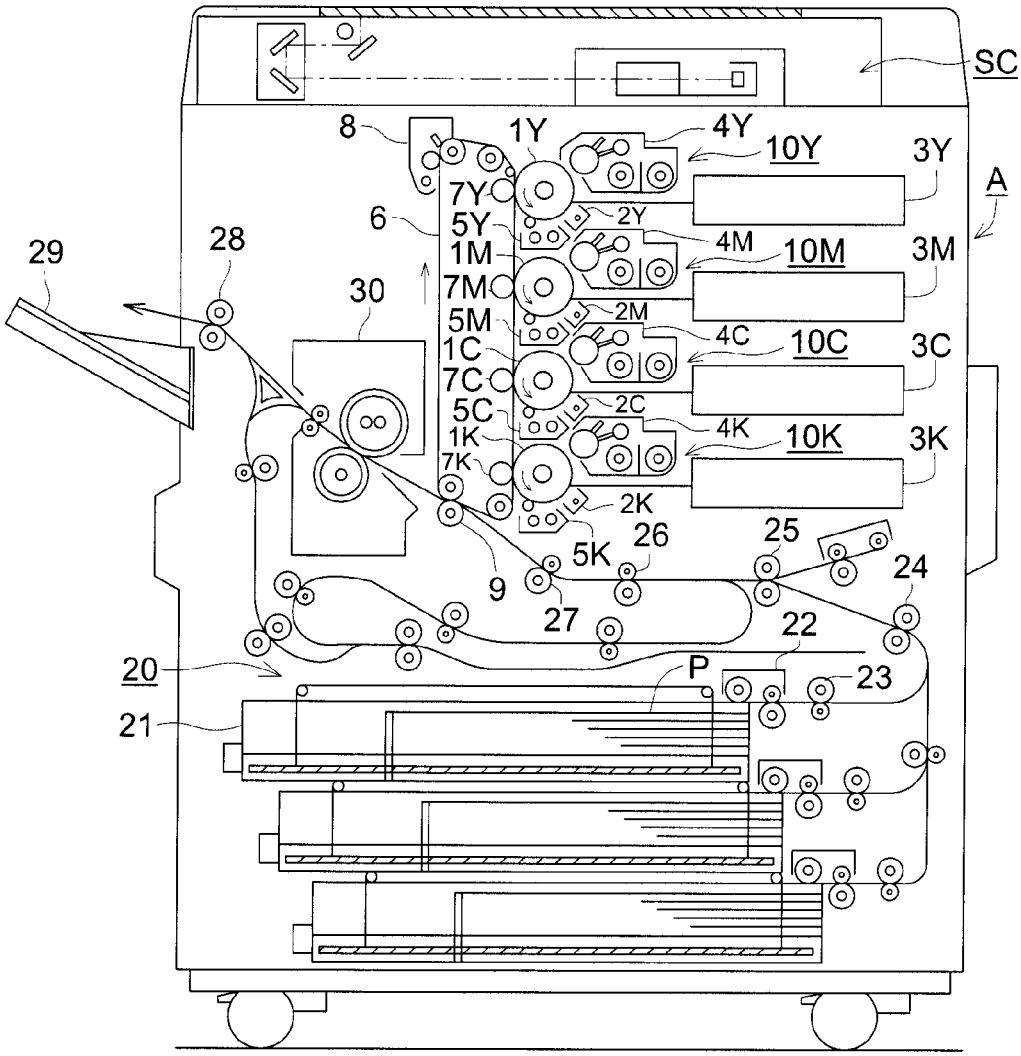
FIG. 1 is a constitutional view showing an embodiment of an image forming apparatus provided with a developing device according to the present invention.

FIG. 1 is a constitutional view showing an embodiment of an image forming apparatus provided with a developing device according to the present invention.

An image forming apparatus A is referred to as a tandem-type color image forming apparatus, which incorporates a plurality of sets of image forming members 10Y, 10M, 10C, and 10K, as well as a belt intermediate transfer body 6, a sheet feed device 20, and a fixing device 30.

An image reading apparatus SC is arranged above the image forming apparatus A. The image of an original document placed on the platen is exposed via scanning by the optical system of an original document image scanning/exposing device of the image reading apparatus SC to be read into a line image sensor. An analog signal, having been photoelectrically converted by the line image sensor, is subjected to analog processing, A/D conversion, shading correction, and image compression processing in an image processing section, followed by being input into light writing members 3Y, 3M, 3C, and 3K.

The image forming member 10Y to form a yellow (Y) color image incorporates a charging member 2Y, a light writing member 3Y, a developing device 4Y, and a cleaning member 5Y arranged in the periphery of a photoreceptor drum 1Y serving as an image carrier. The image forming member 10M to form a magenta (M) color image incorporates a photoreceptor drum 1M as an image carrier, a charging member 2M, a light writing member 3M, a developing device 4M, and a cleaning member 5M. The image forming member 10C to form a cyan (C) color image incorporates a photoreceptor drum 1C as an image carrier, a charging member 2C, a light writing member 3C, a developing device 4C, and a cleaning member 5C. The image forming member 10K to form a black (K) color image incorporates a photoreceptor drum 1K as an image carrier, a charging member 2K, a light writing member 3K, a developing device 4K, and a cleaning member 5K.

The charging member 2Y and the light writing member 3Y, the charging member 2M and the light writing member 3M, the charging member 2C and the light writing member 3C, and the charging member 2K and the light writing member 3K each constitute a latent image forming member.

Then, 4Y, 4M, 4C, and 4K are developing devices each accommodating a two-component developer incorporating a small particle diameter toner of yellow (Y), magenta (M), cyan (C), and black (K) and a carrier.

The intermediate transfer body 6 is wound by a plurality of rollers and rotatably supported thereby.

Each color image having been formed by the image forming members 10Y, 10M, 10C, and 10K is successively transferred onto the intermediate transfer body 6, being rotating, by primary transfer members 7Y, 7M, 7C, and 7K to form a composed color image.

A recording medium (hereinafter referred to as a recording sheet) P stored in a sheet feed cassette 21 of the sheer feed device 20 is fed by a sheet feed member (a first sheet feed section) 22 and conveyed to a secondary transfer member 9 via sheet feed rollers 23, 24, 25, and 26, as well as a registration roller (a second sheet feed section) 27, whereby the color image is transferred onto the recording sheet P.

Herein, the triple sheet feed cassettes 21 tandemly arranged in the vertical direction at the bottom of the image forming apparatus A each have almost the same constitution. Further, the triple sheet feed members 22 each have almost the same constitution. The sheer feed device 20 is referred to in the form of containing the sheet feed cassettes 21 and the sheet feed members 22.

With regard to the recording sheet P on which the color image has been transferred, the recording sheet P is nipped in the fixing device 30 and a color toner image (or a toner image) on the recording sheet P is fixed by applying heat and pressure for fixation on the recording sheet P, which is then nipped by sheet discharge rollers 28 and placed onto a sheet discharge tray 29 outside the apparatus.

On the other hand, the color image is transferred onto the recording sheet P by the secondary transfer member 9 and thereafter, the residual toner is removed by the cleaning member 8 from the intermediate transfer body 6 from which the recording sheet P has been curvature-separated.

Herein, in the description of the image forming apparatus A, description has been made on color image formation. However, cases in which a black and white image is formed are also contained in the present invention.

Hereinafter, the photoreceptors 1Y, 1M, 1C, and 1K are collectively referred to as an image carrier (hereinafter referred to as a photoreceptor drum) 1 and the charging members 2Y, 2M, 2C, and 2K are collectively referred to as a charging member 2. And, the light writing members 3Y, 3M, 3C, and 3K are collectively referred to as a light writing member 3 and the developing devices 4Y, 4M, 4C, and 4K are collectively referred to as a developing device 4.

Figure 2:
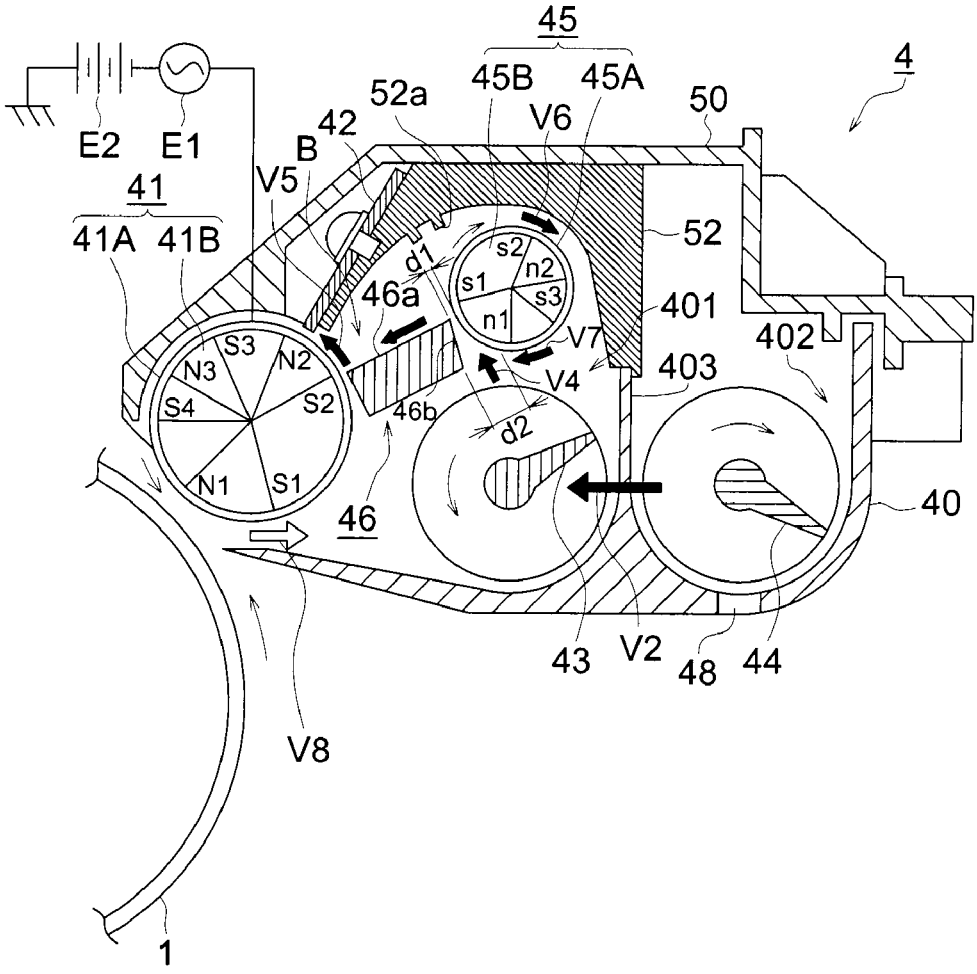
FIG. 2 is a sectional view showing a first embodiment of a developing device according to the present invention.
Figure 3:
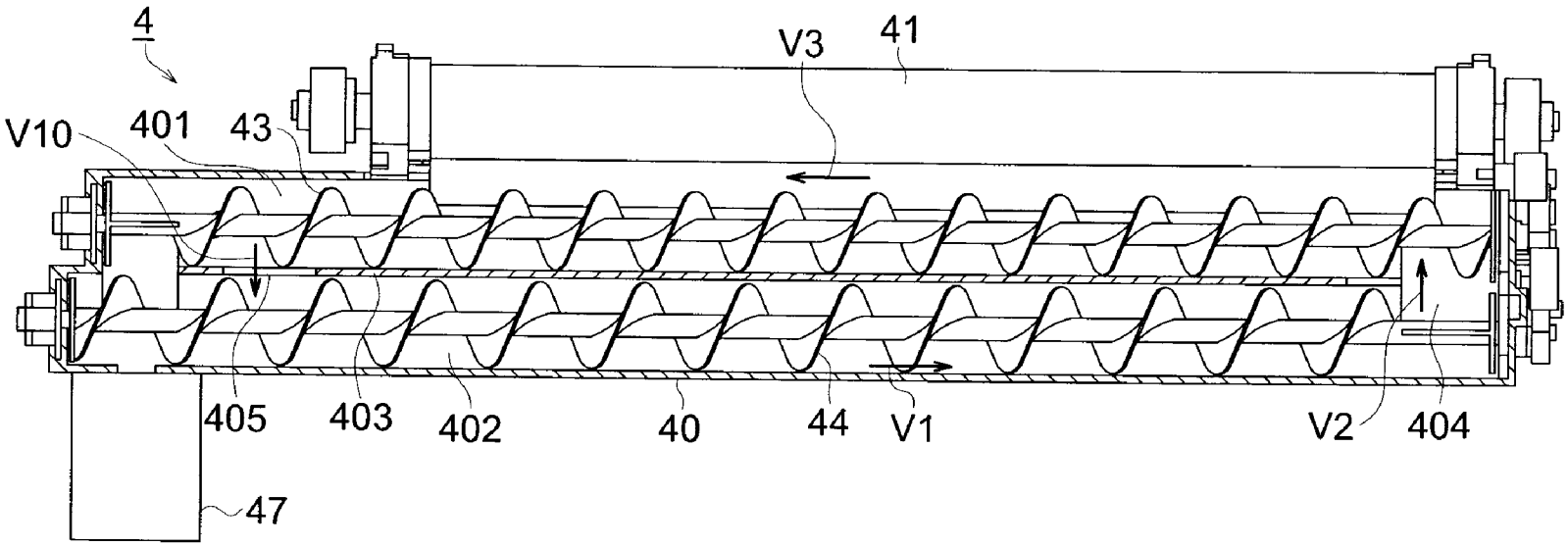
FIG. 3 is a bottom view in which a lower casing 40 is removed from the developing device shown in FIG. 2.

FIG. 2 is a sectional view showing a first embodiment of a developing device according to the present invention and FIG. 3 is a bottom view in which a lower casing 40 is removed from the developing device shown in FIG. 2.

The housing of the developing device 4 features a two-divided constitution incorporating a bottom lower casing 40 and a top upper casing 50, being openable and closable.

In the lower casing 40 of the developing device 4, arranged are a developing roller 41, a first developer stirring and conveying roller 43 and a second developer stirring and conveying roller 44 which are a first and a second developer stirring and conveying roller, respectively, a developer feed roller 45, and a developer guide member 46.

The lower casing 40 incorporates a developer conveying/feeding chamber 401 to house the first developer stirring and conveying roller 43 and a developer stirring chamber 402 to house the second developer stirring and conveying roller 44. The developer conveying/feeding chamber 401 and the developer stirring chamber 402 are formed on both sides of a dividing wall section 403, which is sandwiched thereby, standing erect from the bottom of the lower casing 40.

In the upper casing 50 covering the upper portion of the lower casing 40, a developer layer thickness regulating member 42 and a space forming member 52 to support the developer layer thickness regulating member 42 are arranged.

The developing roller 41 incorporates a rotatable developing sleeve 41A and a fixed magnet roll 41B serving as a fixed magnetic member.

At the opposite adjacent point of the developing sleeve 41A and the first developer stirring and conveying roller 43, the developing sleeve 41A rotates upward from downward and the first developer stirring and conveying roller 43 rotates downward from upward.

In FIG. 2 and FIG. 3, in one end of the dividing wall section 403, a first opening section 404 is formed on the downstream side in the developer conveying direction of the dividing wall section 403 in order to ensure the pathway of a developer conveying path V2 to convey a developer, moving on the developer conveying path shown by the arrow V1, from the developer stirring chamber 402 to the developer conveying/feeding chamber 401. On the other hand, in the other end of the dividing wall section 403, a second opening section 405 is formed on the downstream side in the developer conveying direction of the dividing wall section 403 in order to ensure the pathway of a developer conveying path V10 to convey the developer moving on the developer conveying path shown by the arrow V3 and the developer recovered after development in a developing area in the downstream direction while mixing and stirring using the first stirring and conveying roller 43 and to convey the developer from the developer conveying/feeding chamber 401 to the developer stirring chamber 402.

On the ceiling portion of the interior of the upper casing 50, the space forming member 52 is fixed to support the developer layer thickness regulating member 42 and to guide the developer conveyed by the developer feed roller 45. Herein, a space B formed by the upper surface of the developer guide member 46, the lower surface of the space forming member 52, the surface of the developer feed roller 45, the surface of the developing sleeve 41A, and the developer layer thickness regulating member 42 between the developer feed roller 45 and the developing sleeve 41A is referred to as a developer standby space.

Incidentally, as a member to form the upper portion of the developer standby space B, an attachment member of the developer layer thickness regulating member 42 and the space forming member 52 are employed, or only the space forming member 52 may be employed without the developer layer thickness regulating member 52.

On the lower surface of the space forming member 52, a plurality of protrusions 52*a* are arranged as developer conveyance smoothing members to prevent conveyance non-uniformity of the developer.

In the developing device 4 of the present embodiment, arrangement of the developer feed roller 45 makes it possible to form a developer layer free from density non-uniformity and pitch non-uniformity on the developing roller 41. Since the developer standby space B was provided, the developer was able to flow smoothly.

The developing roller 41 is arranged opposite to the photoreceptor drum 1 to carry an electrostatic latent image, and driven and rotated by an unshown drive source. The developing sleeve 41A is superimposed with an alternating voltage via an alternating power source E1 and a direct voltage via a direct power source E2 as a developing bias.

The magnet roll 41B is arranged in the interior side of the developing sleeve 41A, having magnetic poles N1, N2, N3, S1, S2, S3, and S4 totaling to 7 poles. The magnetic pole N1 is a magnetic pole and the magnetic pole S1 is a removing magnetic pole. The magnetic pole S2 is a pumping-up magnetic pole. The developer layer thickness regulating member 42 is arranged in the vicinity of the magnetic pole N2 of the magnet roll 41B.

Of a plurality of the magnetic poles of the magnet roll 41B, 2 magnetic poles S1 and S2 adjacent to each other are arranged with the same polarity to form a repulsive magnetic field. The removing magnetic pole S1 for developer removal removes and disperses the developer on the developing sleeve 41A. The developer having been removed from the developing sleeve 41A is transferred to the first developer stirring and conveying roller 43, followed by being stirred while conveyed in the direction parallel to the rotational axis of the developing roller 41. The pumping-up magnetic pole S2 for developer acceptance pumps up the developer having been fed by the developer feed roller 45 to allow the developer to adhere onto the developing sleeve 41A.

The first developer stirring and conveying roller 43 stirs and conveys the developer having been conveyed from the second developer stirring and conveying roller 44 to uniformly feed the developer to the developer feed roller 45. The first developer stirring and conveying roller 43 and the second developer stirring and conveying roller 44 each are made of a spiral screw member.

The second developer stirring and conveying roller 44 is arranged parallel to the first developer stirring and conveying roller 43, mixing, with stirring, a fresh toner replenished from a toner replenishing member 47 with the developer flowed back from the developing sleeve 41A to convey the resulting mixture to the upstream portion of the first developer stirring and conveying roller 43.

The first developer stirring and conveying roller 43 conveys the developer in the rotational axis direction and also releases the developer in the direction almost at right angles to the rotational axis.

The developer layer thickness regulating member 42 is formed with a magnetic body, regulating the layer thickness of the developer on the developing sleeve 41A.

In embodiments of a developing device according to the present invention, the developer feed roller 45 is provided with a magnet roll 45B serving as a fixed magnetic member having a plurality of fixed magnetic poles and a sleeve 45A rotatably arranged in the external circumference of the magnet roll 45B.

In a first embodiment according to the present invention, the magnet roll 45B incorporates magnetic poles n1, n2, s1, s2, and s3 totaling to 5 poles. Further, the sleeve 45A rotates (clockwise as shown in FIG. 2) to convey a developer conveyed by the first developer stirring and conveying roller 43 upward from the gap between the sleeve 45A and the developer guide member 46.

With regard to the magnetic poles of the magnet roll 45B, the n1 pole is arranged above the first developer stirring and conveying roller 43 and then the s1, s2, n2, and s3 poles are arranged in the rotational direction of the sleeve 45A in this sequential order. Of the repulsive poles s1 and s2, the s1 pole is arranged at a position where the sleeve 45A faces the developer amount regulating section 45*b* of the developer guide member 46 in the vicinity.

The repulsive pole s1 of the developer feed roller 45 of the present invention is arranged a position where the sleeve 45A faces the developer amount regulating section 45*b* for the developer feed roller 45 in the vicinity, whereby a developer having entered the developer standby space B is easy to separate from the sleeve 45A.

The developer is attracted, by the n1 pole, from the first developer stirring and conveying roller 43 to the sleeve 45A of the developer feed roller 45, followed by being loaded thereon to form a developer layer. The developer loaded on the sleeve 45A is conveyed to the s1 pole via rotation of the sleeve 45A and then released from the surface of the sleeve 45A between the repulsive poles s1 and s2.

The developer guide member 46 is provided with a guide section 46*a* to guide the developer conveyed by the developer feed roller 45 to the developing roller 41; and a developer amount regulating section 46*b* to regulate the amount of the developer conveyed from the first developer stirring and conveying roller 43 by a gap created with the developer feed roller 45.

The developer guide member 46 is obliquely arranged among the developer feed roller 45, the developing sleeve 41A, and the first developer stirring and conveying roller 43, separating the upper developer fed to the developing sleeve 41A from the lower developer removed from the developing sleeve 41A and then conveyed.

Of the gaps d1 and d2 formed by the developer amount regulating section 46*b* and the developer feed roller 45, the gap d1 on the downstream side of the developer conveying direction (d1 is has the minimum value for the gap between the developer amount regulating section 46*b* and the developer feed roller 45) is set to a smaller value than the layer thickness of a developer layer formed on the sleeve 45A of the developer feed roller 45.

The value of the gap d1 is set to be such a smaller value than the layer thickness of a developer layer formed on the sleeve 45A in the vicinity of the n1 pole of the developer feed roller 45, whereby the layer thickness of the developer layer formed on the sleeve 45A is regulated to always have a constant value.

The gaps d1 and d2 between the developer amount regulating section 46*b* and the developer feed roller 45 are critical factors from the viewpoint of appropriately maintaining the developer amount in the developer standby space B. The values of the gaps d1 and d2 are appropriately set in consideration of the developer amount in the developer standby space B.

Of the gaps d1 and d2, the gap d2 on the upstream side of the developer conveying direction is set to be larger than the gap d1 on the downstream side. As a gap to regulate the developer amount conveyed into the developer standby space B, the gap d1 of the downstream side is specifically critical.

Further, with regard to the installing position of the developer guide member 46, in the present embodiment, a fixed system is employed. However, a system adjustable to the developer feed roller 45 is employable.

According to the present invention, the developer amount regulating section 46*b* is provided for the developer guide member 46 and also the gap d1 created with the developer feed roller 45 is set to be smaller than the layer thickness of a developer layer on the sleeve 45A in the vicinity of the n1 pole, whereby the layer thickness of the developer layer on the sleeve 45A is set to have a constant value. The layer thickness of the developer layer on the sleeve 45A is set to have such a constant value, whereby the developer amount conveyed into the developer standby space B is prevented from increasing excessively, resulting in the prevention of application of an excessive stress to the developer.

Still further, when a developing device according to the present invention is used, the distance from the position where the developer amount in the developer standby space B is regulated to the developing roller 41 is decreased, compared to the conventional system in which a developer feed roller 45 is orbited. Thereby, the developer is conveyed to the developing roller 41 while the effect of regulating the developer amount is maintained, and then the developer amount in the developer standby space B is more easily regulated.

The developer standby space B in the present embodiment is designated as a range from the region linking the magnetic pole center of the s3 pole of the magnet roll 45B of the developer feed roller 45 and the edge surface of the space forming member 52 in the upstream side of the developer conveying direction to the surface of the developing roller 41 in the downstream side of the developer conveying direction.

On the other hand, when the developer is saturated in the developer standby space B, most of the overflowed developer is conveyed to s2, n2, and s3 in this sequential order via rotation of the sleeve 45A and then recirculated to the n1 pole. Part of the developer falls down onto the first developer stirring and conveying roller 43 between the n2 pole and the n1 pole by gravity, and then in the vicinity of the n1 pole, the developer conveyed from the first developer stirring and conveying roller 43 is replenished.

At the position where the magnet roll 45B in the present invention faces the first developer stirring and conveying roller 43, the s3 pole and the n1 pole each differing in polarity are adjacently arranged, resulting in a constitution in which the developer having been overflowed from the developer standby space B is hard to fall down onto the first developer stirring and conveying roller 43 side. This constitution produces such an advantage that even when changed in bulk, the developer can stably be fed to the developing roller 41.

Figure 4:
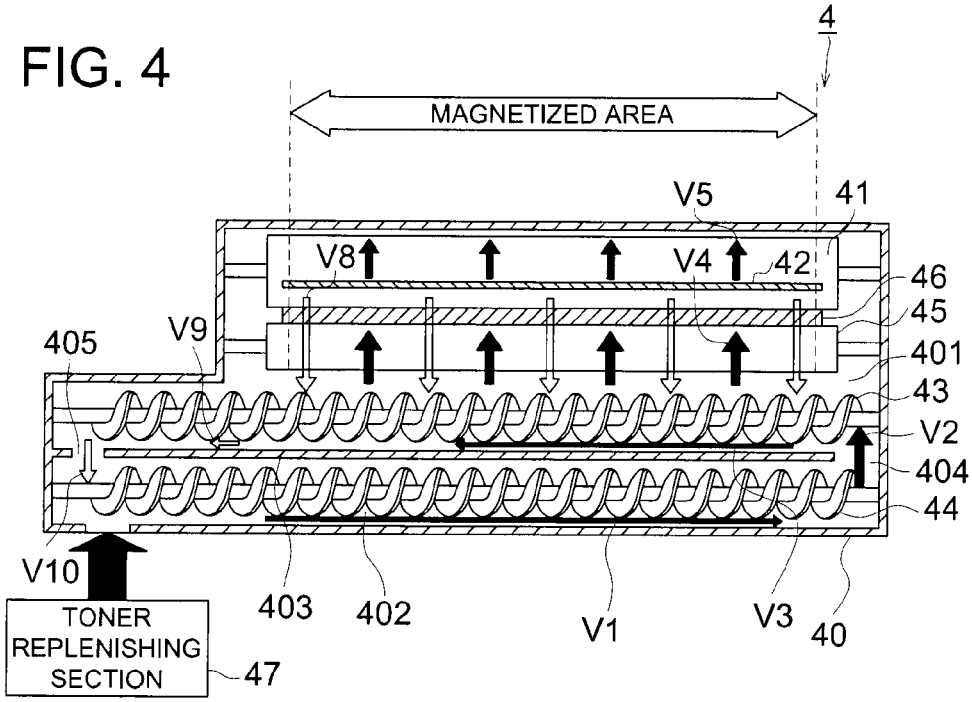
FIG. 4 is a schematic view showing a path in which a developer is circularly conveyed in a developing device 4 according to the present invention.

FIG. 4 is a schematic view showing a path in which a developer is circularly conveyed in a developing device 4 according to the present invention. The path in which the developer is circularly conveyed will now be described with reference to FIG. 2 and FIG. 4.

(1) In the upstream side of the developer conveying direction of the developer stirring chamber 402, a developer flowed back from the developer conveying/feeding chamber 401 and a fresh toner replenished from the toner replenishing member 47 are conveyed, followed by being stirred and mixed by the second developer stirring and conveying roller 44. The resulting mixture is then conveyed on the developer conveying path shown by the arrow V1.

(2) The developer from the developer conveying/feeding chamber 401 and the developer mixed with the toner are passed through a first opening section 404 on the downstream side of the developer stirring chamber 402 and conveyed on the developer conveying path shown in the arrow V2, followed by being introduced into the upstream side of the developer conveying/feeding chamber 401. In the developer conveying/feeding chamber 401, the developer is stirred while conveyed on the developer conveying path shown by the arrow V3 by the first developer conveying/stirring roller 43.

(3) While conveying the developer on developer conveying path V3, the first developer stirring and conveying roller 43 releases the developer to the developer transferring path shown by the arrow V4 toward the developer feed roller 45. The developer is attracted to the n1 pole of the magnet roll 45B of the developer feed roller 45 arranged opposite to the first developer stirring and conveying roller 43 to form, on the surface of the sleeve 45A, a developer layer, which is then conveyed toward the s1 pole in the rotational direction (clockwise) of the sleeve 45A.

In this case, the layer thickness of the thus-formed developer layer is regulated by the above gaps d1 and d2 created between the surface of the sleeve 45A of the developer feed roller 45 and the developer amount regulating section 46*b* of the developer guide member 46 to appropriately maintain the amount conveyed into the developer standby space B.

(4) When the developer conveyed by the developer feed roller 45 is reached to the position of the s1 pole of the repulsive poles s1 and s2 of the magnet roll 45B, the developer is released from the surface of the sleeve 45A and then conveyed into the developer standby space B. The developer conveyed into the developer standby space B is deposited on an inclined plane of the guide section 46*a* of the developer guide member 46.

Further, when the released developer is saturated in the developer standby space B, the developer in the developer standby space B is attracted to the sleeve 45A in the vicinity of the s2 pole by the rotating sleeve 45A and then moved in the rotational direction of the sleeve 45A shown by the arrow V6.

The developer having been overflowed from the developer standby space B is conveyed, along the surface of the sleeve 45A, from the s2 pole to the n2 pole based on the magnetic pole arrangement of the magnet roll 45B in the direction of separating from the developing roller 41 and then released to the outside from the interior of the developer standby space B in the vicinity of the s3 pole.

Via further rotation of the sleeve 45A, the developer on the sleeve 45A is conveyed from the s3 pole to the n1 pole in the arrow V7 direction and joined with the developer conveyed from the first developer stirring and conveying roller 43 at the position of the n1 pole, followed being conveyed again (recirculated) into the developer standby space B at the position of the s1 pole.

According to the present invention, when the developer is saturated in the developer standby space B, the developer feed roller 45 rotates in the direction of separating the overflowing developer from the developing roller 41 to discharge the developer to the exterior of the developer standby space B, resulting in the prevention of an excessive increase in the developer amount.

(5) The developer having been deposited on the developer guide member 46 is attracted by the rotating sleeve 41A and carried thereon, and then regulated by the developer layer thickness regulating ember 42 into a uniform layer thickness to be conveyed on the developer conveying path shown by the arrow V5.

The developer having been carried on the developing sleeve 41A at such a uniform layer thickness is subjected to developing processing in a developing area facing the photoreceptor drum 1. After developing processing, the developer having a resulting decreased toner density is removed from the developing roller 41 by the removing magnetic pole S1 of the magnet roll 41B.

(7) The thus-removed developer is conveyed on the developer conveying path shown by the arrow V8 and conveyed into the developer conveying/feeding chamber 401.

(8) The developer having been conveyed into the developer conveying/feeding chamber 401 is conveyed on the developer conveying path shown by the arrow V9 by the first developer stirring and conveying roller 43 and passed through the second opening section 405, and then moved to the developer conveying path shown by the arrow V10 to be introduced into the upstream side of the developer stirring chamber 402.

(9) In the developer stirring chamber 402, toner replenishment is carried out by the toner replenishing member 47 based on a toner density detection signal of a toner density detection sensor 48. The developer having been replenished with a toner is joined with the developer conveyed to the developer conveying path V1.

The developer is conveyed in a circulating system as described above. Part of the developer is not conveyed to the developing area but circulated in such an order as shown by the developer conveying paths V1, V2, V3, V9, and V10 between the developer conveying/feeding chamber 410 and the developer stirring chamber 402.

According to the first embodiment of the developing device of the present invention, most of a developer having been overflowed from the developer standby space B is recirculated without being released from the developer feed roller 45 and conveyed again to the developer feed roller 45, resulting in such an advantage that a remaining old toner is preferentially consumed.

Figure 5:
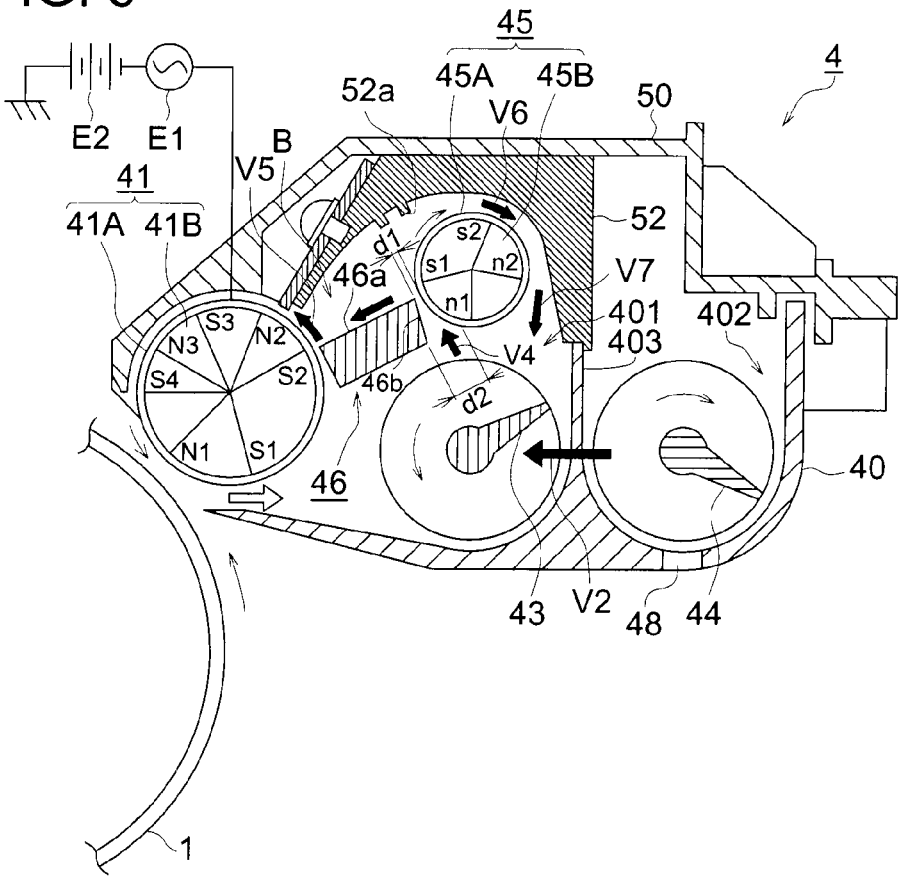
FIG. 5 is a sectional view showing a second embodiment of a developing device according to the present invention.

FIG. 5 is a sectional view showing a second embodiment of a developing device according to the present invention.

The second embodiment of a developing device according to the present invention is similar to the first embodiment. Any member having the same constitution and function is designated with the same alphanumeric designation. Therefore, no description will be made and the constitution will be described only with respect to differences.

The difference of the second embodiment from the first embodiment lies in the magnetic pole arrangement of the magnet roll 45B of the developer feed roller 45. Namely, the magnetic poles of the first embodiment are n1, n2, s1, s2, and s3 totaling to 5 poles. In contrast, the magnetic poles of the second embodiment are n1, n2, s1, and s2 totaling to 4 poles.

With regard to the magnetic poles of the magnet roll 45B, the n1 pole is arranged above the first developer stirring and conveying roller 43 and then the s1, s2, and n2 poles are arranged in the rotational direction of the sleeve 45A in this sequential order. Of the repulsive poles s1 and s2, the s1 pole is arranged at a position where the sleeve 45A faces the developer amount regulating section 46*b* for the developer feed roller 45. The repulsive poles n2 and n1 are arranged at a position opposite to the first developer stirring and conveying roller 43.

The developer standby space B in the present embodiment is designated as a range from the region linking the magnetic pole direction of the n2 pole of the magnet roll 45B of the developer feed roller 45 and the space forming member 52 in the upstream side of the developer conveying direction to the surface of the developing roller 41 in the downstream side of the developer conveying direction.

A developer is attracted, by the n1 pole, onto the sleeve 45A of the developer feed roller 45 from the first developer stirring and conveying roller 43 and conveyed to the s1 pole via rotation of the sleeve 45A, followed by entering the developer standby space B to be released from the surface of the sleeve 45A between the repulsive poles s1 and s2. The thus-released developer is conveyed to the developing roller 41 via a guide section 46*a* of the developer guide member 46 and then the layer thickness of the developer is regulated by the developer layer thickness regulating member 42 for layer formation on the developing roller 41. The developer having been eliminated via regulation using the developer layer thickness regulating member 42 is allowed to stand by in the developer standby space B.

On the other hand, when the developer standby space B is saturated, the developer having been overflowed therefrom is conveyed to the s2 and n2 poles via rotation of the sleeve 45A, followed by being conveyed to a position with the repulsive poles n2 and n1 which are a pair of poles with the same polarity to be released from the sleeve 45A (the developer standby space B). The thus-released developer falls down onto the first developer stirring and conveying roller 43, followed by being stirred and conveyed. Then, part of the developer is conveyed again (recirculated) to the developer feed roller 45 in the vicinity of the n1 pole. Most of the developer not being conveyed to the developer feed roller 45 is conveyed again to the first developer stirring and conveying roller 43 and the developer feed miler 45 via the second developer stirring and conveying roller 44.

With regard to the difference of the second embodiment from the first embodiment in developer movement, in the first embodiment, most of the developer having been overflowed from the developer standby space B is recirculated to the n1 pole via rotation of the sleeve 45A, and in contrast, in the second embodiment, most of the developer is released in the V7 direction at the position of the repulsive pole n2.

Then, the released developer is divided into the developer to be conveyed again (recirculated) from the first developer stirring and conveying roller 43 to the developer feed roller 45 in the V4 direction and the developer returning to the developer feed roller 45 via the second developer stirring and conveying roller 44 and the first developer stirring and conveying roller 43.

Part of the developer recirculated by the developer feed roller 45 does not fall between the n2 pole and the n1 pole but directly is joined with the developer conveyed from the first developer stirring and conveying roller 43 by the n1 pole for recirculation.

According to the second embodiment of the developing device of the present invention, most of a developer having been overflowed from the developer standby space B is conveyed again (recirculated) to the developer feed roller 45 therefrom via the second developer stirring and conveying roller 44 and the first developer stirring and conveying roller 43. Thereby, produced are such advantages that the developer is sufficiently stirred and also the developer in the developing device is averaged, whereby uniform performance is easily realized.

EXAMPLES

Description will now be made with respect to the setting conditions and results of the experiments conducted using the developing devices of Example 1 and Example 2 produced based on the first and second embodiments of a developing device according to the present invention, as well as a developing device as Comparative Example I employing the conventional system.

(Common Conditions)

[Image Formation Conditions]

Image forming apparatus: Used was a modified experimental apparatus of an A4-size sheet, full-color tandem-type digital color copier (Konica Minolta 8050 (a registered trademark), refer to FIG. 1) featuring an output capacity of 50 sheets in the following conditions: recording density: 600 dpi, process speed: 300 mm/s, image area rate (in the photoreceptor moving direction): 62.5%, and image exposure light source: semiconductor laser (a wavelength of 780 nm).

[Developing Device]

Diameter of developing sleeve 41A: ϕ30 mm

Formed magnetic field portion length (in the axial direction) of magnet roll 41B: 330 mm Moving speed (ratio comparison to photoreceptor speed) of developing roller 41: 2.0

Rotational direction (to the photoreceptor) of developing roller 41: reverse rotation Developer conveyed amount on developing roller 41: 260-360 g/m$^2$ Gap between the photoreceptor and developing roller 41: 0.3 mm Gap between developing roller 41 and developer guide member 46: at most 3 mm Gap between developer layer thickness regulating member 42 and the magnetic blade as well as developer roller 41 surface: 0.6 mm

[Developing Bias Application Members]

DC bias (E2): −500 V

AC bias (E1): 1 kVpp (square wave, 5 kHz)

[Developer]

Volume average particle diameter of a carrier: 33 μm, magnetization strength: 60 emu/g Volume average particle diameter of a polymerized toner: 6.5 μm Developer amount: 1100 g (for Y, M, C, and K each)

Toner density of the developer: 7.5% by mass

[Photoreceptor Drum]

External diameter 60 mm (for Y, M, C, and K each)

VH potential: −700 V

VL potential: −50 V

Example 1

[Developing Device] (Refer to FIG. 1)

Developer feed roller 45: having a sleeve 45A and a magnet roll 45B

Sleeve 45A: external diameter 16 mm, clockwise rotating

Magnet roll 45B: having n1, n2, s1, s2, and s3 poles totaling to 5 magnetic poles The incline angle of each magnetic pole is expressed in such a manner that a straight line extending upward vertically from the rotational axis center of the magnet roll 45B is designated as a base angle of 0° and an angle created when clockwise rotation is made is expressed as the inclined angle of the each magnetic pole.

s2 pole: inclined angle 20°, magnetic flux density 50 mT (mTesla)

n2 pole: inclined angle 80°, magnetic flux density 60 mT s3 pole: inclined angle 130°, magnetic flux density 50 mT n1 pole: inclined angle 180°, magnetic flux density 60 mT s1 pole: inclined angle 265°, magnetic flux density 20 mT The inclined angle of the s2 pole is preferably set at a value between 10°-30°. When the angle is set at less than 10°, the amount of the developer conveyed from the developer standby space B in the V6 direction is increased and then the developer amount therein is decreased, whereby the developer amount to be fed to the developing roller 41 becomes unstable.

Further, when the inclined angle of the s2 pole is set at more than 30°, decreased is the effect of conveying the developer filled in and overflowed from the developer standby space B to the exterior thereof.

Developer guide member: the gap between the magnetic material and the developer feed roller: d1=1.2 mm and d2=4.0 mm Example 2

[Developing Device] (Refer to FIG. 5)

Developer feed roller 45: having a sleeve 45A and a magnet roll 45B

Sleeve 45A: external diameter 16 mm, clockwise rotating

Magnet roll 45B: having n1, n2, s1, and s2 poles totaling to 4 magnetic poles The incline angle of each magnetic pole is expressed in such a manner that a straight line extending upward vertically from the rotational axis center of the magnet roll 45B is designated as a base angle of 0° and an angle created when clockwise rotation is made is expressed as the inclined angle of the each magnetic pole.

s2 pole: inclined angle 20°, magnetic flux density 60 mT (mTesla)

n2 pole: inclined angle 100°, magnetic flux density 20 mT n1 pole: inclined angle 180°, magnetic flux density 60 mT s1 pole: inclined angle 265°, magnetic flux density 20 mT The inclined angle of the s2 pole is preferably set at a value between 10°-30°. When the angle is set at less than 10°, the amount of the developer conveyed from the developer standby space B in the V6 direction is increased and then the developer amount therein is decreased, whereby the developer amount to be fed to the developing roller 41 becomes unstable.

Further, when the inclined angle of the s2 pole is set at more than 30°, decreased is the effect of conveying the developer filled in and overflowed from the developer standby space B to the exterior thereof.

Developer guide member: the gap between the magnetic material and the developer feed roller: d1=1.2 mm and d2=4.0 mm Comparative Example 2

Figure 6:
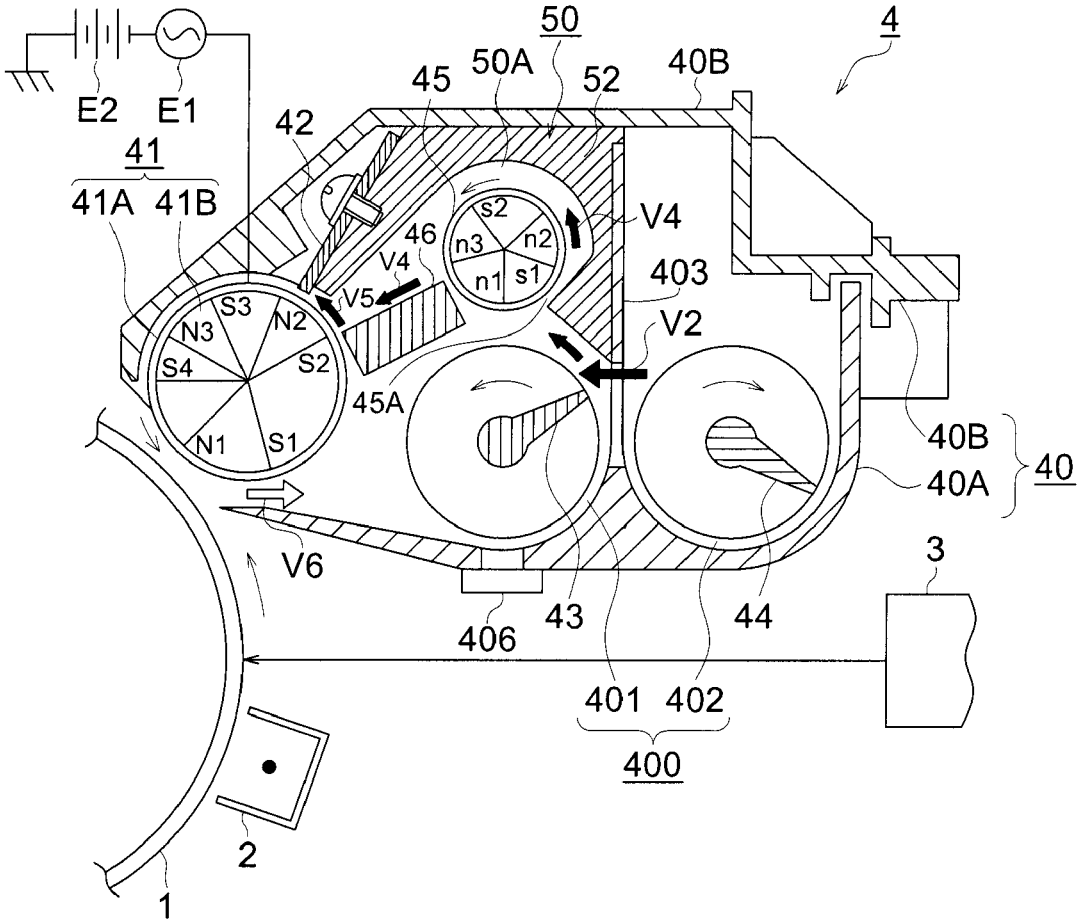
FIG. 6 shows a developing device 4 having the constitution disclosed in Patent Document 1.

[Developing Device] (Refer to FIG. 6)

Developer feed roller 45: having a sleeve 45A and a magnet roll 45B

Sleeve 45A: external diameter 16 mm, counterclockwise rotating

Magnet roll 45B: having n1, n2, n3, s1, and s2 poles totaling to 5 magnetic poles The incline angle of each magnetic pole is expressed in such a manner that a straight line extending upward vertically from the rotational axis center of the magnet roll 45B is designated as a base angle of 0° and an angle created when clockwise rotation is made is expressed as the inclined angle of the each magnetic pole.

n2 pole: inclined angle 40°, magnetic flux density 50 mT (mTesla)

s1 pole: inclined angle 115°, magnetic flux density 60 mT n1 pole: inclined angle 180°, magnetic flux density 65 mT n3 pole: inclined angle 250°, magnetic flux density 25 mT s2 pole: inclined angle 325°, magnetic flux density 60 mT (Evaluation Method of Graininess in Image Quality)

The evaluation of density non-uniformity of an output image is caned out via a visual judgment in which using the above image forming apparatus, an image of a printing rate of 0% is formed on 5,000 sheets and then 10,000 sheets, and thereafter a solid image, a halftone image (intermediate density), and a halftone image (low density) are output.

(Evaluation Method of Developer Packing)

The formed state of a developer layer on the surface of the sleeve 41A of the developing roller 41 was visually observed to confirm the presence or absence of an adverse effect caused by developer conveying non-uniformity.

(Evaluation Method of Carrier Development)

In the evaluation of carrier development of an output image, conducted is an evaluation on whether or not the carrier adheres to an output image after a durability test of 400,000 sheets under a high temperature/humidity ambience.

(Evaluation Method of Density Non-Uniformity)

The evaluation of density non-uniformity of an output image is carried out via a visual judgment in which using the image forming apparatus, a solid image, a halftone image (intermediate density), and a halftone image (low density) are output.

(Judgment)

The evaluation ranking of each item is expressed based on our in-house product quality judgment criteria as follows: definite confirmation of pitch non-uniformity is designated as C meaning the defective product level; confirmation thereof to some extent is designated as B meaning the good product acceptable level; and no confirmation level is designated as A meaning the good product level.

The experimental results are shown in Table 1.

TABLE 1

| | Graininess in Image Quality | | Developer Packing | Carrier Development | | |
|---|---|---|---|---|---|---|
| | After 5000-sheet Printing | After 10000-sheet Printing | After 20000-sheet Printing | After 300000-sheet Printing | After 400000-sheet Printing | Pitch Non-uniformity |
| Example 1 | A | B | A | A | A | A |
| Example 2 | A | A | A | A | A | A |
| Comparative Example 1 | B | C | B | A | B | B |

In Example 1, image quality (graininess) in the sold image and the halftone images after 10000-sheet image formation was judged at the good product acceptable level. However, no problems were noted with respect to developer packing on 20000-sheet image formation, carrier development on 400000-sheet image formation, and screw pitch non-uniformity.

In Example 2, every item was judged at the good product level.

In Comparative Example 1, with regard to image quality (graininess) in the solid image and the halftone images after 10000-sheet image formation, image roughness was pronounced, which was judged at the defective product level, whereby an adverse effect caused by developer conveying non-uniformity was confirmed. Further, with regard to image quality (graininess) in the solid image and the halftone images after 5000-sheet image formation, developer packing on 20000-sheet image formation, carrier development on 400000-sheet image formation, and screw pitch non-uniformity, each quality was judged at the good product acceptable level.

DESCRIPTION OF THE ALPHANUMERIC DEGIGNATIONS

| | |
|---|---|
| 4: | developing device |
| 41: | developing roller |
| 41A: | sleeve |
| 41B: | magnet roll |
| 42: | developer layer thickness regulating member |
| 43: | first developer stirring and conveying roller (first stirring and conveying member) |
| 44: | second developer stirring and conveying roller (second stirring and conveying member) |
| 45: | developer feed roller |
| 45A: | sleeve |
| 45B: | magnet roll (fixed magnetic member) |
| 46: | developer guide member |
| 46a: | guide section |
| 46b: | developer amount regulating section |
| 52: | space forming member |
| B: | developer standby space |
| d1 and d2: | gaps between the developer guide member and the developer feed roller |
| n1 , n2, s1, s2, and s3: | magnetic poles |

The invention claimed is:

1. A developing device comprising:

a stirring and conveying member to convey a developer while stirring;

a developing roller which supports and conveys the developer to a developing area;

a developer feed roller, arranged above the stirring and conveying member, to receive a developer conveyed from the stirring and conveying member and to feed the developer toward the developing roller;

a developer guide member, arranged between the developer feed roller and the developing roller, to guide a developer conveyed by the developer feed roller toward the developing roller while the developer is allowed to accumulate; and a space forming member, arranged above the developer feed roller and the developer guide member, to form a developer standby space, together with the developing roller, the developer feed roller, and the developer guide member, to allow the developer to temporarily stand by before feeding the developer to the developing roller, wherein the developer feed roller rotates in a direction such that a developer having been overflowed from the developer standby space is conveyed away from the developing roller.

2. The developing device, described in claim 1, wherein the developer feed roller, incorporates in an interior thereof a fixed magnetic member provided with a plurality of magnetic poles, includes a rotating sleeve arranged in an external circumference of the fixed magnetic member, loads a developer conveyed from the stirring and conveying member onto the sleeve to form a developer layer;

the developer guide member is provided with a developer amount regulating section at a position opposite to the developer feed roller; and a minimum value of a gap between the developer amount regulating section and the developer feed roller is set to be smaller than a thickness of a developer layer formed on the sleeve.

3. The developing device, described in claim 1, wherein the developer feed roller, incorporates in an interior thereof a fixed magnetic member provided with a plurality of magnetic poles, includes a rotating sleeve arranged in an external circumference of the fixed magnetic member, loads a developer conveyed from the stirring and conveying member onto the sleeve to form a developer layer;

the developer guide member is provided with a developer amount regulating section at a position opposite to the developer feed roller; and repulsive magnetic poles are arranged in the fixed magnetic member in a rotating direction of the sleeve from a position opposite to the developer amount regulating section.

4. The developing device, described in claim 1, wherein the developer feed roller, incorporates in an interior thereof a fixed magnetic member provided with a plurality of magnetic poles, includes a rotating sleeve arranged in an external circumference of the fixed magnetic member, loads a developer conveyed from the stirring and conveying member onto the sleeve to form a developer layer;

the developer guide member is provided with a developer amount regulating section at a position opposite to the developer feed roller; and an N pole and an S pole are arranged at a position opposite to the stirring and conveying member of the fixed magnetic member.

5. The developing device, described in claim 1, wherein the developer feed roller, incorporates in an interior thereof a fixed magnetic member provided with a plurality of magnetic poles, includes a rotating sleeve arranged in an external circumference of the fixed magnetic member, loads a developer conveyed from the stirring and conveying member onto the sleeve to form a developer layer;

the developer guide member is provided with a developer amount regulating section at a position opposite to the developer feed roller; and magnetic poles which are repulsive poles are arranged at a position opposite to the stirring and conveying member of the fixed magnetic member.

* * * * *